US010213931B2

(12) United States Patent
Krause

(10) Patent No.: US 10,213,931 B2
(45) Date of Patent: Feb. 26, 2019

(54) HAIR CLIPPER BLADE SET WITH TRANSPORT ELEMENT

(71) Applicant: WAHL GMBH, Unterkirnach (DE)

(72) Inventor: Roberto Krause, Villingen-Schwenningen (DE)

(73) Assignee: WAHL GMBH, Unterkirnach (DE)

( * ) Notice: Subject to any disclaimer, the term of this patent is extended or adjusted under 35 U.S.C. 154(b) by 0 days.

(21) Appl. No.: 15/212,746

(22) Filed: Jul. 18, 2016

(65) Prior Publication Data

US 2017/0015010 A1 Jan. 19, 2017

(30) Foreign Application Priority Data

Jul. 17, 2015 (DE) ..... 10 2015 111 690

(51) Int. Cl.
*B26B 19/38* (2006.01)
*B26B 19/04* (2006.01)
*B26B 19/20* (2006.01)

(52) U.S. Cl.
CPC ..... *B26B 19/3813* (2013.01); *B26B 19/042* (2013.01); *B26B 19/20* (2013.01); *B26B 19/3846* (2013.01)

(58) Field of Classification Search
CPC ..... B26B 19/3813; B26B 19/3833; B26B 19/3826; B26B 19/382
See application file for complete search history.

(56) References Cited

U.S. PATENT DOCUMENTS

| | | | | |
|---|---|---|---|---|
| 1,871,700 A * | 8/1932 | Jeppsson | B26B 19/24 30/216 |
| 2,262,388 A | 11/1941 | Dalkowitz | |
| 2,294,713 A * | 9/1942 | Boerger | B26B 19/40 30/123 |
| 2,325,267 A | 7/1943 | Murphy | |
| 2,704,887 A * | 3/1955 | Andis | B26B 19/06 30/210 |
| 5,898,999 A * | 5/1999 | Chaouachi | B26B 19/20 30/200 |
| 5,979,060 A * | 11/1999 | Holzbauer | B26B 19/20 30/200 |
| 6,073,350 A | 6/2000 | Elston et al. | |
| 2009/0126201 A1 | 5/2009 | Melton | |

(Continued)

FOREIGN PATENT DOCUMENTS

| | | |
|---|---|---|
| DE | 197 34 423 A1 | 2/1998 |
| DE | 10 2006 058 111 A1 | 6/2008 |

(Continued)

*Primary Examiner* — Sean Michalski
*Assistant Examiner* — Fernando Ayala
(74) *Attorney, Agent, or Firm* — Muirhead and Saturnelli, LLC

(57) ABSTRACT

A hair clipper with a blade set, includes at least one stationary or one adjustable cutting comb and one shearing blade driven in oscillation in the transverse direction essentially parallel to the front edge of the cutting comb. The hair clipper may have a hair transport element, which has a transport toothing, which is arranged essentially along the cutting edge of the shearing blade at a distance from the cutting edge of the shearing blade. The shearing blade is arranged between the cutting comb and the hair transport element. The cutting edge of the shearing blade extends beyond the front edge of the hair transport element.

20 Claims, 4 Drawing Sheets

(56) References Cited

U.S. PATENT DOCUMENTS

| | | | | |
|---|---|---|---|---|
| 2012/0090182 | A1* | 4/2012 | Heerlein | B26B 19/24 30/228 |
| 2012/0272533 | A1* | 11/2012 | Sobagaki | B26B 19/205 30/201 |
| 2012/0297630 | A1 | 11/2012 | Krause | |

FOREIGN PATENT DOCUMENTS

| | | | |
|---|---|---|---|
| DE | 10 2011 076 577 | B3 | 6/2012 |
| RU | 56 255 | U1 | 9/2006 |
| RU | 2012 100 231 | A | 7/2013 |
| WO | WO 2006/000935 | A1 | 1/2006 |

* cited by examiner

HAIR CLIPPER BLADE SET WITH TRANSPORT ELEMENT

TECHNICAL FIELD

This application relates to a hair clipper and more particularly to hair clipper having a hair transport element used in connection with a blade set for a hair clipper.

BACKGROUND OF THE INVENTION

Hair clippers are known in the prior art in a multitude of designs. Thus, for example, DE 60 2005 003 368 T2 describes a hair clipper with a housing and at least one clipping unit, which comprises a stationary clipping component and a driven clipping component, which executes a back and forth movement in relation to the stationary clipping component.

Hair clippers with a plurality of clipping units are also known in the prior art. Thus, for example, DE 20 2013 103 187 U1 discloses a hair clipper with two clipping units.

DE 10 2011 076 577 B3 discloses a blade set receiver for a hair clipper, with a receiver base, which can be attached to the hair clipper, and a receiving leg which is mounted pivotably on the receiving base, on which an interchangeable blade set can be arranged, while a locking element is provided which can move between a swivel position and a locking position and which is able to block a swivel movement of the receiving leg in the direction of the receiving base without a blade set being arranged on the receiving leg.

A hair clipper with an interchangeable blade set, consisting of at least one cutting comb and a shearing blade driven in oscillation in the transverse direction by a driver essentially parallel to the front edge of the cutting comb, as well as a cut length adjusting device, consisting of an activating element, which is hinged on a housing of the hair clipper and which acts on the blade set so that a relative displacement between the cutting comb and the shearing blade in the lengthwise direction is possible, is disclosed for example in DE 10 2009 015 276 A1.

The known hair clippers and blade sets for hair clippers have, however, a major drawback; when cutting hair with the blade sets known in the prior art for hair clippers there is a buildup of hair pieces on the hair clipper depending on the cutting position. This buildup of hair pieces on the one hand obstructs the view of the cutting area and on the other hand impedes the feeding of the hair not yet cut. The barber must therefore tilt the appliance to the side after each buildup of hair, or shake the hairs out from the blade set of the appliance. This is especially burdensome when a last fine haircut is being done.

Accordingly, it is desirable to provide a blade set for a hair clipper which does not have this drawback, as well as provide a hair clipper with such a blade set.

SUMMARY OF THE INVENTION

The blade set according to the system described herein has at least one stationary or one adjustable cutting comb and one shearing blade driven in oscillation in the transverse direction essentially parallel to the front edge of the cutting comb, as well as a hair transport element, which has a transport toothing having teeth arranged essentially along and at a distance from the cutting edge of the shearing blade. The hair transport element may be part of the blade set, for example, when the entire blade set is interchangeable. The shearing blade is arranged between the cutting comb and the hair transport element, while the cutting edge of the shearing blade extends beyond the front edge of the hair transport element formed by the tips of the teeth of the transport toothing. With an adjustable cutting comb, the distance of the hair transport device relative to a housing of the hair clipper remains the same.

The blade set may be designed as an interchangeable head of a hair clipper, in which advantageously shearing blade, cutting comb and hair transport element are already joined to each other, so that it can be quickly interchanged with a customary blade set known in the prior art, without any hair transport element.

The transport toothing advantageously has an essentially sawtooth cross sectional profile. By "essentially sawtooth profile" is meant a cross sectional profile in which the teeth each have a steep flank and a flat flank. The steep flank is determined so that the angle of rise relative to the base line of the transport toothing, i.e., the line on which and along which the teeth of the transport toothing are arranged, is more steep than the angle of rise between the flat flank and the base line. The tips of the teeth may also be flattened and/or rounded. The steep flanks of the teeth preferably have angles of essentially 90° relative to the base line, the term "essentially 90°" in this context including angles between 80° and 100°.

The hair transport element is either firmly joined to the shearing blade, being preferably joined to the shearing blade over its surface, or it interacts with the movement of the shearing blade relative to the cutting comb via a connecting element. For example, the hair transport element may be joined to the shearing blade via a driver and driven in oscillation. Thanks to the fact that the shearing blade with the hair transport element moves back and forth quickly on the cutting comb when cutting the hair, the hairs are cut off and accelerated on the steep flanks of the sawteeth of the hair transport element, likewise moving back and forth, in the direction of the back and forth movement of the shearing blade, i.e., in the transverse direction to the cutting direction, and moved away from the hair clipper and removed. The cutting direction is a direction perpendicular to the cutting edge of the shearing blade.

Since hairs are cut off along the entire cutting edge, the transport toothing in advantageous embodiments extends essentially along the entire cutting edge of the shearing blade, so that the teeth of the transport toothing are arranged on the hair transport element running essentially along the entire cutting edge of the shearing blade, in order to catch possibly all the hairs that are cut off and remove the hair from the hair clipper.

So that the hairs that are cut off are accelerated not only in one of the two transverse directions of the back and forth motion of the shearing blade relative to the cutting comb, but also some of the hair pieces are accelerated in the one transverse direction and other hair pieces in the other transverse direction, so that the hair pieces are ejected both to the left and right from the hair clipper, the transport toothing has a first and a second section, while the steep flanks of the sawteeth of the first section of the transport toothing and the steep flanks of the sawteeth of the second section of the transport toothing point in essentially opposite directions to each other. The angle between the two essentially opposite directions is preferably between 160° and 200°.

In an especially preferred embodiment, the sawteeth in the first section of the transport toothing are fashioned in mirror symmetry to the sawteeth in the second section of the transport toothing, the mirror axis running perpendicular to the base line of the transport toothing and through the center of the transport toothing, so that the first section and the second section border each other in mirror symmetry to form the transport toothing such that the steep flanks of the teeth of the transport toothing point in mutually opposite directions. In this way, hairs cut off can be ejected at both sides of the hair clipper.

The transport toothing in an advantageous embodiment has a middle tooth at the center, which can be fashioned for example as a triangle or similar to a triangle, preferably having two steep flanks. But the middle tooth can also be rectangular or trapezoidal, for example. In the case of a mirror symmetry arrangement of the teeth of the transport toothing, the mirror axis extends through the center of the middle tooth, so that both sections of the transport toothing each have a half middle tooth.

The teeth of the transport toothing have essentially triangular or triangle-like cross section profiles.

The envelope curve of the transport toothing has essentially four interconnected segments, which enclose or encompass the transport toothing. The first segment of the envelope curve is formed by the front edge of the hair transport element, which is defined by the total number of the shortest connections between neighboring tips of individual teeth of the transport toothing. The second segment is formed by the base line of the transport toothing, i.e., the line on which the base surfaces of the teeth are arranged, said base surfaces being situated opposite the tips of the teeth. The third and fourth segment of the envelope curve is formed by the two side boundaries of the transport toothing.

The tips of the teeth of the transport toothing thus span the first part of the envelope curve. Advantageously, the first part of the envelope curve forms a convex boundary of the transport toothing, while a straight boundary shall also be considered a convex boundary in this disclosure. Preferably, the transport toothing is configured such that the envelope curve of the transport toothing encloses the entire transport toothing in convex manner.

In an especially preferred embodiment, the front edge of the hair transport element runs parallel to the cutting edge of the shearing blade. The distance between the front edge of the hair transport element, i.e., the front edge of the transport toothing, and the cutting edge of the shearing blade is preferably between 1 mm and 5 mm. Thus, in optimal manner, it can be assured that the hairs that are cut off are moved away to the side from the middle of the hair clipper by the hair transport element.

The distance between the front edge of the cutting comb and the cutting edge of the shearing blade is preferably adjustable with an activating element, which is either coupled to the blade set and thus can be part of the blade set or coupled to the hair clipper. Preferably, the relative position of the cutting edge of the shearing blade to the front edge of the hair transport element remains the same when the distance between the front edge of the cutting comb and the cutting edge of the shearing blade is changed, but embodiments are also conceivable in which this distance may be varied, in order to make possible an optimal ejecting of the hairs from the hair clipper given the required length of the hair pieces.

The hair clipper according to the system described herein is preferably electrically operated. Besides the blade set according to the system described herein, the hair clipper has advantageously a housing, which is firmly connected for example to the cutting comb and encloses an electric motor for driving the shearing blade in oscillation. Furthermore, the hair clipper preferably has a driver, which is connected to the electric motor and the shearing blade so that it drives the shearing blade in oscillation, preferably in the transverse direction to the cutting direction when the electric motor is turned on. Optionally, the cutting comb may be fastened to the housing. However, the hair transport element is advantageously either connected firmly to the shearing blade or connected to the shearing blade in such a way that the hair transport element moves along with the shearing blade when the shearing blade is driven in oscillation, so that the buildup of hair pieces does not obstruct the view of the cutting area and does not impede or block the feeding of the hair being cut. The hair transport element of the blade set of the hair clipper has in an embodiment an engagement to receive the driver.

The terms used in the following description, such as top, bottom, left and right and similar ones refer to the figures and should in no way be limiting, even if they pertain to preferred embodiments. The phrase "essentially" in regard to angles and arrangements should encompass deviations of up to 20°, preferably up to 10°, unless otherwise indicated.

BRIEF DESCRIPTION OF THE DRAWINGS

Embodiments of the system described herein will now be explained in more detail in accordance with the figures of the drawings, which are briefly described as follows.

DETAILED DESCRIPTION OF VARIOUS EMBODIMENTS

Figure 1:
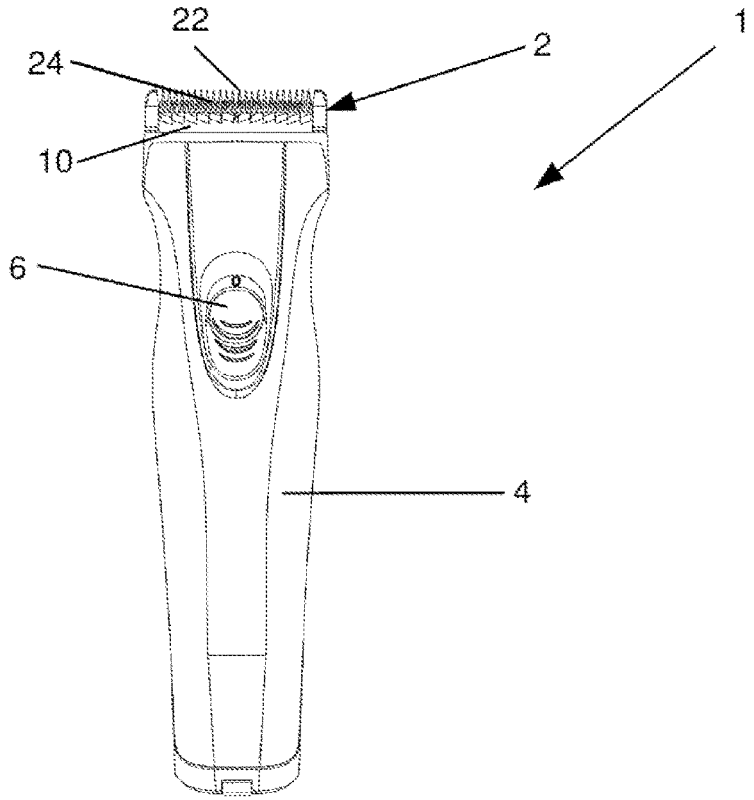
FIG. 1 shows a hair clipper, according to an embodiment of the system described herein.

FIG. 1 shows a hair clipper 1 with a blade set 2, as well as a housing 4 in which an electric motor (not shown in FIG. 1) is arranged. The electric motor may be turned on and off with an electric switch 6.

Figure 2:
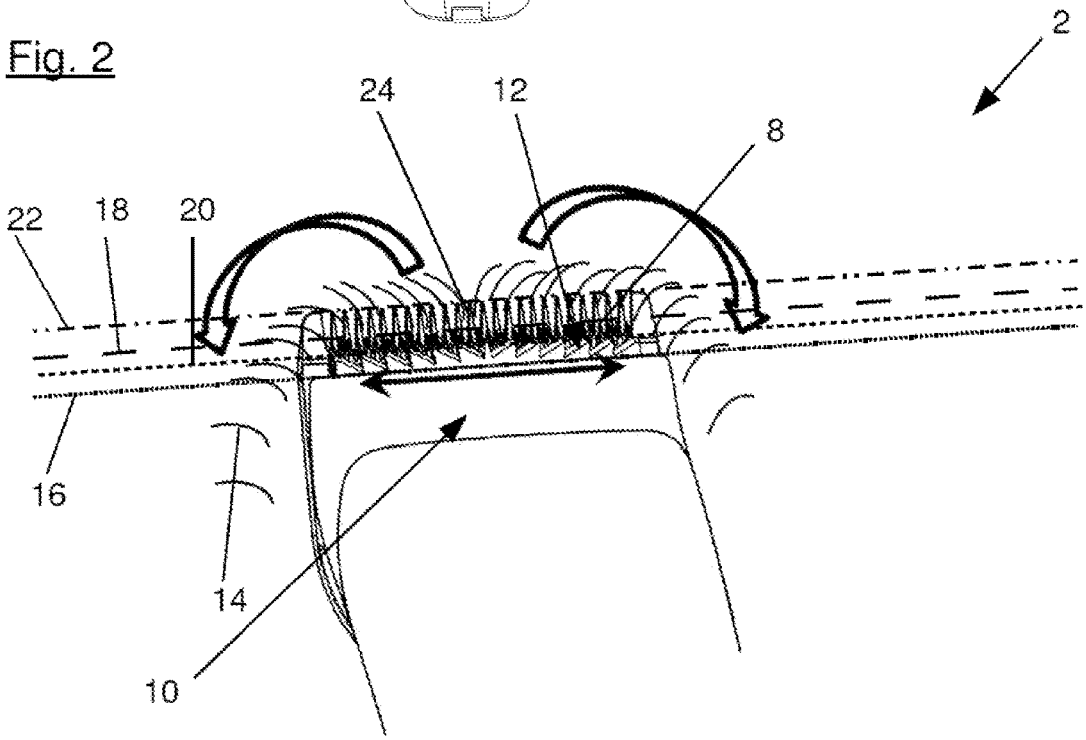
FIG. 2 shows a blade set of a hair clipper with a hair transport element according to an embodiment of the system described herein.

FIG. 2 shows part of the blade set 2 of FIG. 1 with a shearing blade 8 and a hair transport element 10, which has a transport toothing 12, being fashioned in the present case as a single piece with the hair transport element 10. The hair transport element 10 is firmly connected to the shearing blade 8 and moves back and forth with the shearing blade 8, so that the transport toothing 12 ejects cut hairs 14 to the right and left and thus automatically moves the hair pieces 14 away from the blade set 2 and both clears up the view of the hairs still being clipped and facilitates the feeding of new pieces of hair.

The hair transport element 10 has a base line 16, on which the transport toothing 12 is placed, or on which the individual teeth of the transport toothing 12 are arranged. Parallel to the cutting edge 18 of the shearing blade 8, which is likewise represented as a broken line in FIG. 2, is arranged the front edge 20 of the hair transport element 12, represented as broken line 20. The front edge 20 of the hair transport element 12 defines, together with the base line 16 of the transport toothing 12 and the two side boundaries of the transport toothing 12, an envelope curve 21, which encloses the transport toothing 12 in a convex manner. The blade set 2 shown in FIG. 2 furthermore has a cutting comb 24, whose front edge 22 is likewise indicated as a broken line.

Figure 3:
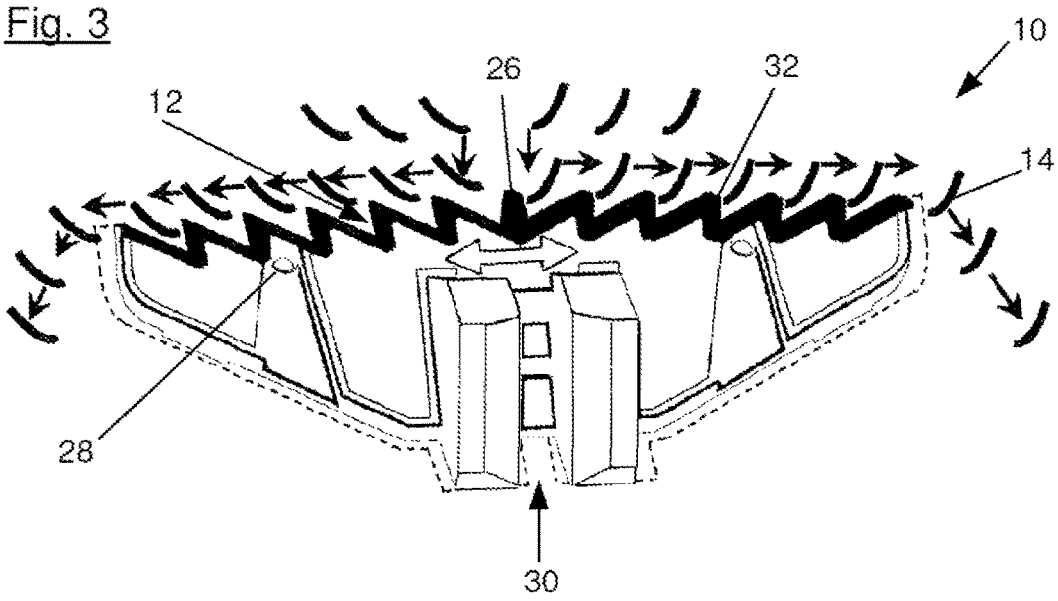
FIG. 3 shows an example of a hair transport element according to an embodiment of the system described herein.

FIG. 3 shows an example of a hair transport elements 10 further enlarged. The transport toothing 12 has a middle tooth 26, two openings 28 which serve to fasten the hair transport element 10 on the shearing blade 8, as well as an engagement 30 for a driver (not shown). The hairs 14, which are cut off to the right of the middle tooth 26 of the hair transport element 10, are transported by the back and forth motion of the hair transport element 10, which is correlated with the back and forth motion of the shearing blade 8 relative to the cutting comb 24, to the right of the sawteeth 32 which are arranged at the right of the middle tooth 26 and ejected in the direction of the right side of the hair transport element 10. The hairs 14, which are cut off to the left of the middle tooth 26 by the shearing blade 8, are transported to the left by the sawteeth 32 which are arranged at the left of the middle tooth 26 on the hair transport element 10 and ejected in the direction of the left side of the hair transport element 10.

FIG. 4 shows four further examples of hair transport elements 10.

Figure 4A:
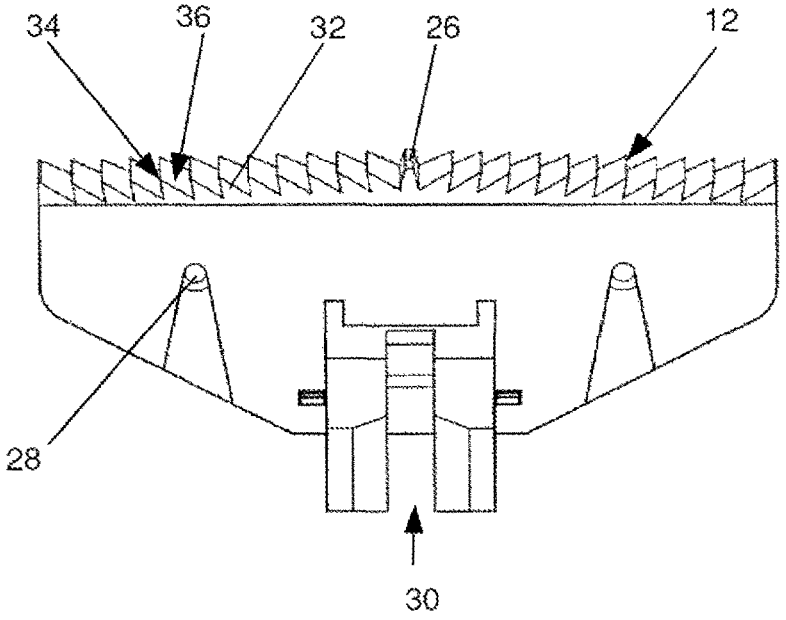
FIGS. 4*a*-4*d* show further examples of a hair transport elements according to embodiments of the system described herein.

As is especially to be seen in FIG. 4*a*, the transport toothing 12 of the hair transport element 10 has, besides a middle tooth 26, sawteeth 32 which each have a steep flank 34 and a flat flank 36. The steep flanks 34 of the sawteeth 32 which are arranged to the left of the middle tooth 26 point to the left, while the steep flanks 34 of the sawteeth 32 which are arranged to the right of the middle tooth 26 point to the right. Thanks to the fact that the steep flanks 34 on both sides of the transport toothing 12 each point outward, i.e., in essentially opposite directions, it can be assured that cut hairs 14 which are clipped off at the left side of the hair clipper 1 are ejected to the left by the back and forth motion of the hair transport element 10, while hairs 14 which are clipped off at the right side of the hair clipper 1 are ejected to the right.

Figure 4B:
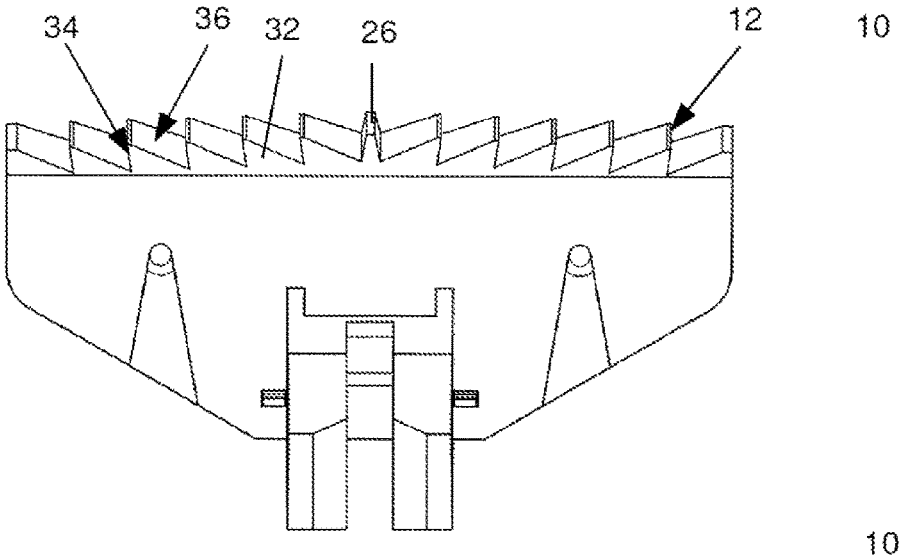

FIG. 4*b* shows a hair transport element 10, similar to FIG. 4*a*, with a middle tooth 26 and sawteeth 32 having steep flanks 34 and flat flanks 36, but fewer and therefore larger sawteeth 32. However, it is also possible to provide hair transport elements 10 which eject the cut hairs 14 in only one direction.

Figure 4C:
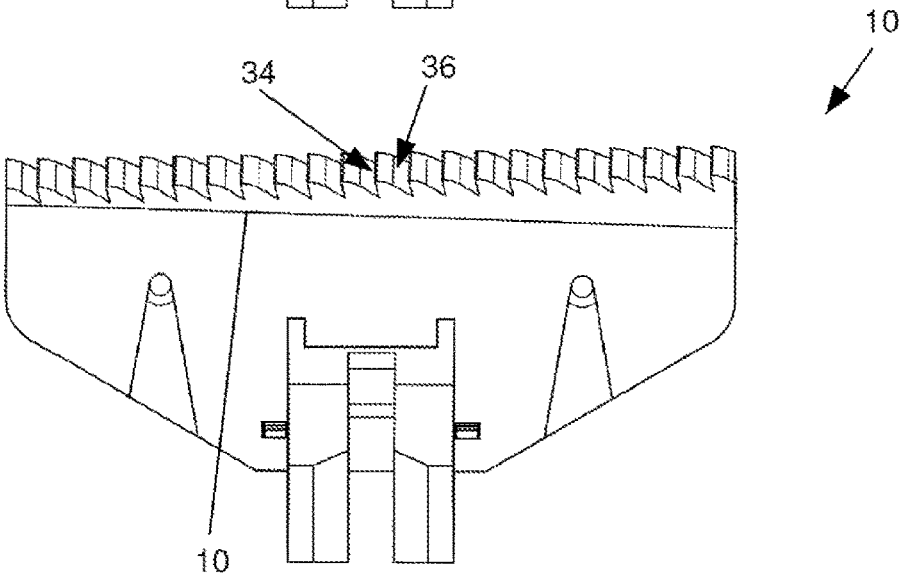
Figure 4D:
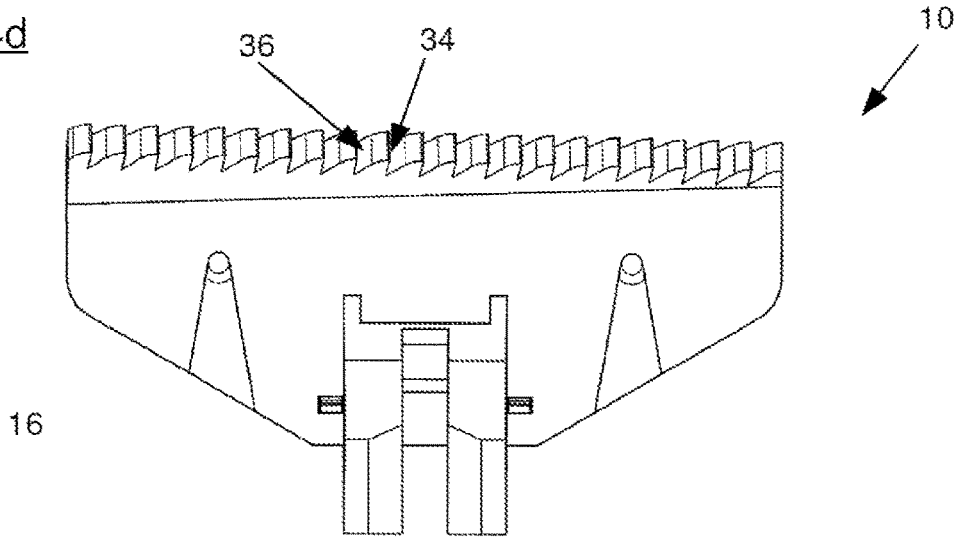

FIG. 4*c* shows a hair transport element 10 without middle tooth 26, in which the hairs are ejected to the left. FIG. 4*d* shows a corresponding hair transport element 10 in which the hairs are ejected to the right. The transport toothing 12 runs in both cases obliquely to the base line 16, namely, from left to right and upward from the base line 16 when the hairs are ejected to the left, as is shown in FIG. 4*c*, and from left to right and downward to the base line 16 when, as in FIG. 4*d*, the hairs are ejected to the right.

An oblique profile of the transport toothing 12 relative to the base line 16 corresponds to an oblique profile of the transport toothing 12 relative to the cutting edge 18 of the hair clipper. This has the advantage that the hair ejected to the left or right are not repeatedly accelerated at the teeth 32 of the transport toothing 12 in the ejection direction, thus ensuring a hair ejection distributed over a broader cross sectional area. For a hair transport to the left, the teeth 32 arranged on the right of the transport toothing 12 are closer to the cutting edge 18 of the hair clipper than the teeth 36 arranged on the left of the transport toothing 12, as is shown in FIG. 4*c*.

In the case of a transport of the cut hairs 14 to the right, the teeth 32 arranged on the left of the transport toothing 12 are closer to the cutting edge 18 of the hair clipper than the teeth 36 arranged on the right of the transport toothing 12, as can be seen in FIG. 4*d*.

Figure 5:
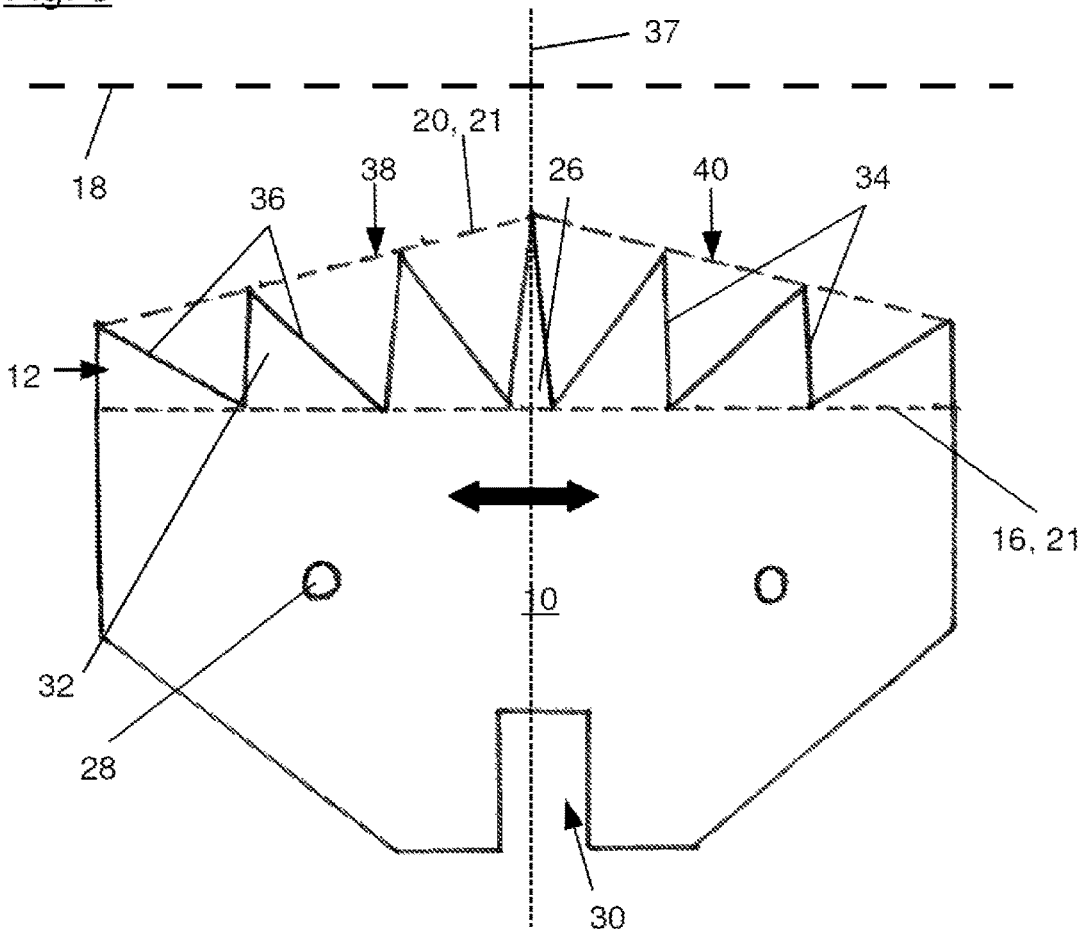
FIG. 5 is a schematic representation of a hair transport element according to an embodiment of the system described herein.

FIG. 5 shows a hair transport element 10 in schematic representation with another configuration of the transport toothing 12. The sawteeth 32 are arranged in mirror symmetry to a central axis 37, also known as the mirror axis 37 and running through the middle tooth 26. The sawteeth 32 arranged at the left of the middle tooth 26 in a first section 38 are oriented with their flat flanks 36 in the direction of the central axis 37 of the hair clipper 1 and point to the left with their steep flanks 34, away from the central axis 37. The sawteeth 32 arranged to the right of the middle tooth 26 in a second section 40 are oriented with their flat flanks 36 in the direction of the central axis 37 of the hair clipper 1 and point to the right with their steep flanks 34, away from the central axis 37. The broken-line envelope curve 21 borders and encloses the transport toothing 12. The envelope curve 21 encloses the teeth 26, 32 of the transport toothing 12 in convex manner. The cutting edge 18 of the shearing blade 8 represented by a broken line in FIG. 5 runs at a distance from the front edge 20 of the hair transport element 10 and thus from the first segment of the envelope curve 21.

Figure 6:
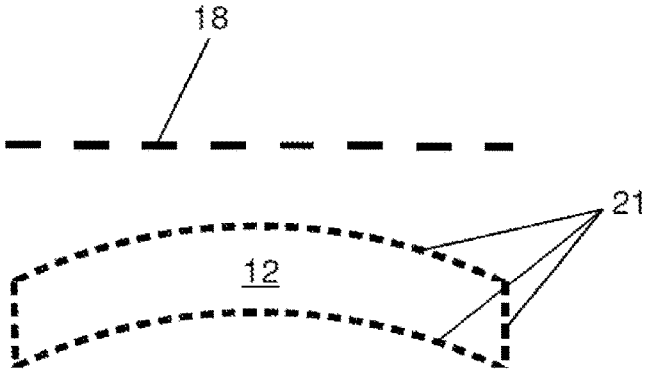
FIG. 6 shows an envelope curve of a possible transport toothing relative to a cutting edge of a shearing blade according to an embodiment of the system described herein.

FIG. 6 shows a concave-convex shaped envelope curve 21, which encloses the teeth 26, 32 of the transport toothing 12. The first segment of the envelope curve 21 runs adjacent to the cutting edge 18 and borders the transport toothing 12 in convex manner, so that the tips of the teeth 32, 26 arranged more in the middle of the transport toothing 12 have a shorter distance from the cutting edge 18 than the teeth 26 arranged closer to the two edges of the transport toothing 12. This has the benefit that hair pieces 14 which have already been moved in a direction outward to the side by a steep flank 34 of a tooth 26, 32 do not experience another change of direction by a flat flank of a tooth 32. In this way, similar to the example in FIG. 5, in which the envelope curve 21 encloses the entire transport toothing 12 in convex manner, hair pieces 14 are quickly and effectively removed from the hair clipper 1. The base line 16 of the transport toothing 12, i.e., the second segment of the envelope curve 21, borders the transport toothing 12 in concave manner in this example.

The invention has been explained with the aid of preferred example embodiments, without being limited to these examples. Individual features of the example embodiments represented in each case can also be combined with each other or exchanged with other features of the same effect, as long as they are compatible. Thus, for example, the teeth of the transport toothing can be fashioned so that the tangential angles of the flat flanks decrease from the base line in the direction of the tips of the individual tooth until they have an angle with the base line of practically zero, for example. Tooth profiles of this shape should also be called "sawtooth-shaped".

What is claimed is:

1. A blade set of a hair clipper, comprising:

a stationary cutting comb;

a shearing blade driven in oscillation in a transverse direction essentially parallel to a front edge of the cutting comb; and a hair transport element arranged to transport hair, the hair transport element having a transport toothing with teeth that are arranged adjacent to one another and are arranged essentially along a cutting edge of the shearing blade at a distance from the cutting edge of the shearing blade, wherein the shearing blade is arranged between the cutting comb and the hair transport element and wherein the cutting edge of the shearing blade extends beyond a front edge of the hair transport element, and wherein the hair transport element has a substantially plate-like form aligned in a co-planar fashion with the shearing blade.

2. A blade set according to claim 1, wherein the transport toothing has an essentially sawtooth profile and wherein sawteeth of the sawtooth profile each have a steep flank and a flat flank.

3. A blade set according to claim 1, wherein the transport toothing of the hair transport element is arranged on the hair transport element running essentially along an entire portion of the cutting edge of the shearing blade.

4. A blade set according to claim 1, wherein the front edge of the hair transport element is essentially parallel to the cutting edge of the shearing blade.

5. A blade set according to claim 1, wherein tips of the teeth of the transport toothing are arranged relative to each other so that the tips define a first section of an envelope curve which forms a convex boundary of the transport toothing.

6. A blade set according to claim 1, wherein the hair transport element is firmly joined to the shearing blade, over a surface thereof.

7. A blade set according to claim 1, wherein the hair transport element is driven in oscillation via a driver with the shearing blade.

8. A blade set according to claim 1, wherein the transport toothing has a first section and a second section, and steep flanks of sawteeth of the first section of the transport toothing and steep flanks of the sawteeth of the second section of the transport toothing point in essentially opposite directions to each other.

9. A blade set according claim 8, wherein the first section of the transport toothing is arranged in mirror symmetry to the second section of the transport toothing.

10. A blade set according to claim 1, wherein the transport toothing has a middle tooth at a center with two steep flanks.

11. A blade set according to claim 1, wherein a distance between the front edge of the cutting comb and the cutting edge of the shearing blade is adjustable while a relative position of the cutting edge of the shearing blade to the front edge of the hair transport element remains constant when a distance between the front edge of the cutting comb and the cutting edge of the shearing blade is changed.

12. A blade set according to claim 11, wherein the distance between a front edge of the cutting comb and the cutting edge of the shearing blade is adjustable with an activating element.

13. A hair clipper, comprising:

a stationary cutting comb;

a shearing blade driven in oscillation in the transverse direction essentially parallel to the front edge of the cutting comb;

a hair transport element arranged to transport hair, the hair transport element having a transport toothing with teeth which are arranged adjacent to one another and are arranged essentially along a cutting edge of the shearing blade at a distance from the cutting edge of the shearing blade, wherein the shearing blade is arranged between the cutting comb and the hair transport element, wherein the cutting edge of the shearing blade extends beyond a front edge of the hair transport element, and wherein the hair transport element has a substantially plate-like form aligned in a co-planar fashion with the shearing blade;

a housing, which encloses an electric motor for driving the shearing blade in oscillation; and a driver, coupled to the electric motor and the shearing blade to drive the shearing blade in oscillation in response to the electric motor being turned on, wherein the hair transport element is one of: coupled firmly to the shearing blade or coupled to the shearing blade in such a way that the hair transport element moves along with the shearing blade when the shearing blade is driven in oscillation.

14. A hair clipper according to claim 13, further comprising:

a hair transport element having an engagement to receive the driver.

15. The blade set according to claim 1, wherein the transport element is arranged to transport hair in the transverse direction.

16. The blade set according to claim 1, wherein the transport element is arranged to eject hair away from the hair clipper.

17. The blade set according to claim 1, wherein the teeth of the transport toothing are arranged along an entire length of the cutting edge of the shearing blade.

18. The blade set according to claim 1, wherein the transport toothing includes at least 5 teeth.

19. The blade set according to claim 2, wherein, for each of the sawteeth, each end of each flat flank terminates at an end of a steep flank.

20. A blade set of a hair clipper, comprising:

a stationary cutting comb;

a shearing blade driven in oscillation in a first direction essentially parallel to a front edge of the cutting comb; and a hair transport element arranged to transport hair, the hair transport element having a transport toothing with teeth arranged essentially along the cutting edge of the shearing blade, wherein the hair transport element has a substantially plate-like form aligned in a co-planar fashion with the shearing blade, and wherein the shearing blade is arranged between the cutting comb and the hair transport element.

* * * * *